United States Patent [19]

Doss

[11] 4,441,267

[45] Apr. 10, 1984

[54] PELT STRETCHER

[76] Inventor: Albert S. Doss, Rte. 2, Box 532, Farmville, Va. 23901

[21] Appl. No.: 293,917

[22] Filed: Aug. 18, 1981

[51] Int. Cl.[3] ..... D06C 3/08; C14B 1/26

[52] U.S. Cl. ..... 38/102.8; 24/27; 38/102.91; 69/19.3

[58] Field of Search ..... 69/19.1, 19.2, 19.3; 38/102.1, 102.2, 102.3, 102.4, 102.5, 102.8, 102.91; 24/19, 20 EE, 20 S, 23 EE, 27, 28, 29

[56] References Cited

U.S. PATENT DOCUMENTS

| | | | |
|---|---|---|---|
| 1,098,295 | 5/1914 | Philipsenburg | 38/102.1 |
| 1,307,522 | 6/1919 | Stuhr | 69/19.2 |
| 1,621,765 | 3/1927 | Bonswor | 38/102.3 |
| 2,283,367 | 5/1942 | Hintz | 38/102.4 |
| 4,274,270 | 6/1981 | Johnson | 69/19.3 |

OTHER PUBLICATIONS

*The Trapper* 8/1981 "For the Beaver Man," advertisement.

*Primary Examiner*—Louis Rimrodt
*Assistant Examiner*—Andrew M. Falik
*Attorney, Agent, or Firm*—Griffin, Branigan & Butler

[57] ABSTRACT

An animal pelt stretching frame of adjustable circular construction. Shoat ring hooks connect the pelt to a ring which has slidable end connections for adjustment and a clamp for locking.

3 Claims, 5 Drawing Figures

PELT STRETCHER

BACKGROUND OF THE INVENTION

Animal pelts have long been stretched on circular wooden frames to which the pelts were secured by sewing. They have also conventionally been stretched on plywood boards to which the pelts were attached by nailing. Both methods require a time consuming operation of attaching the pelt to the support, and any peripheral adjustment after mounting has begun is also time consuming. The board method has the further disadvantage of exposing only one side of the pelt.

SUMMARY OF THE INVENTION

The present invention provides an improved system of stretching a pelt, using a peripherally adjustable ring of spring material, a clamp to lock the ring after it has been adjusted, and hooks securing the pelt to the ring. The ring is preferably of resilient steel wire extending to a circle plus a substantial overlap when in a relaxed condition.

BRIEF DESCRIPTION OF THE DRAWING

The accompanying drawing schematically illustrates a present preferred embodiment of the pelt stretcher of the invention, in which.

DETAILED DESCRIPTION OF THE PREFERRED EMBODIMENT

Figure 1:
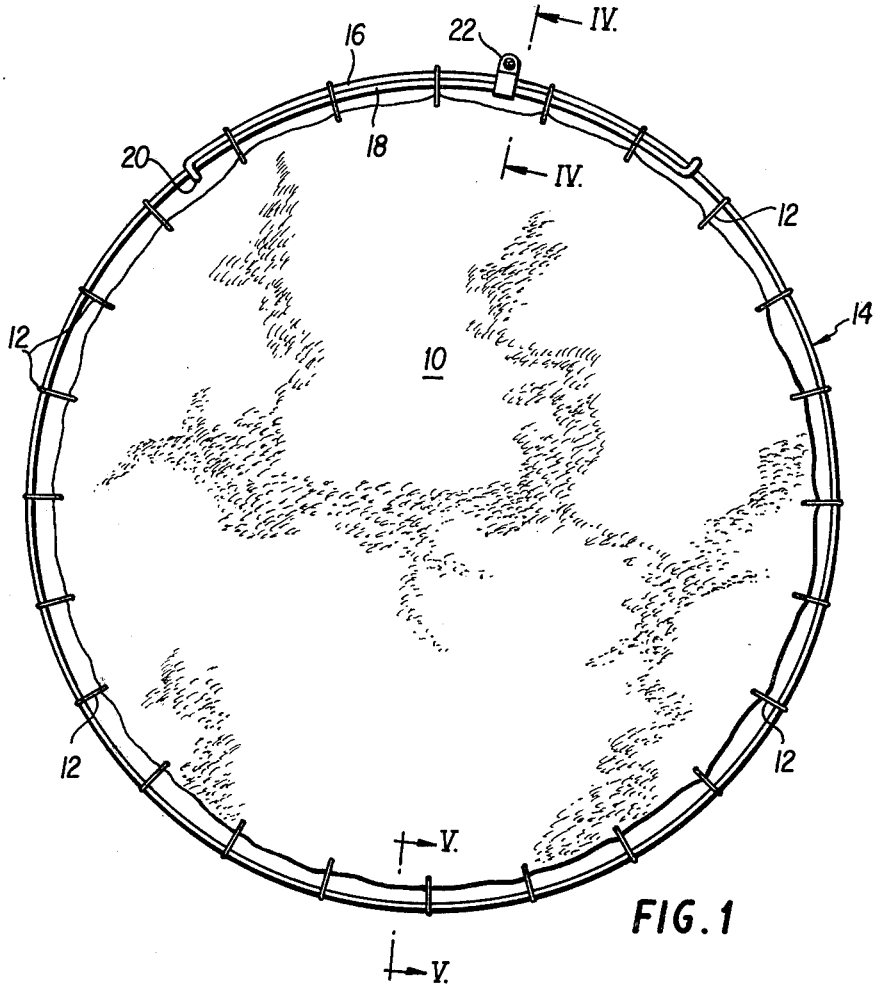
FIG. 1 is a plan view of a pelt mounted in the stretcher of the invention.

Referring now more particularly to the drawing, and initially to FIG. 1, there is shown an animal pelt 10 secured by a series of spaced hooks 12 to a circular frame 14.

Figure 2:
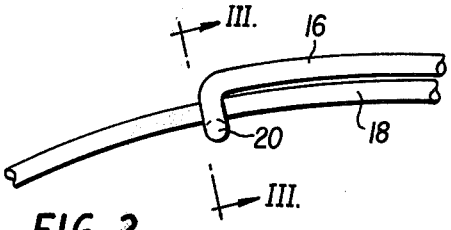
FIG. 2 is an enlarged and partially broken away detail view of the attachment of one end of the wire frame shown in FIG. 1 to an overlapping portion of the wire frame.
Figure 3:
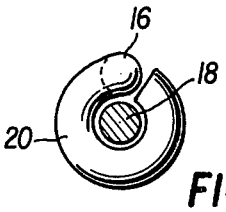
FIG. 3 is a section of the line III—III in FIG. 2.
Figure 4:
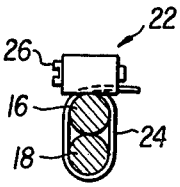
FIG. 4 is an enlarged section taken on the line IV—IV in FIG. 1, showing the clamp holding the wire frame but omitting the pelt and hooks securing the pelt to the frame; and, FIG. 5 is an enlarged section of the line V—V in FIG. 1, showing details of a hook holding the pelt on the wire frame.

The frame 14 is a circular length of elongated resilient material, preferable quarter-length diameter music wire. The end portions 16 and 18 of the frame 14 have a substantial overlap, and each of these ends is heated and bent to hook around the adjacent portion of the other end so as to be slidable therealong. For example, the overlapping wire end 16 has a hook portion 20 extending around the overlapping wire end 18, as shown in FIGS. 2 and 3. The wire ends 16 and 18 are thus readily slideable along each other to adjust the diameter and length of the periphery of the frame 14. When the desired diameter and periphery has been determined for a particular pelt to be mounted in the frame, a clamp 44 around the wire ends 16 and 18 is tightened to lock these wire ends together and thus lock the frame in its desired setting. As shown in FIG. 4, the clamp 22 is preferably of the so-called hose clamp type, consisting of a flexible metal band 24 which can be tightened around the wire end 16 and 18, and an adjustable screw 26 which engages a slot in the band 24 to operate in worm gear fashion to tighten or loosen the band 24.

Figure 5:
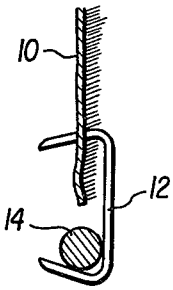

The hooks 12 are preferably steel U-shaped hooks of the kind known as "shoat rings" and used in the noses of pigs to prevent them from rooting (as well as other known uses, such as securing automobile seat covers). As shown in FIG. 5, one end of the hook 12 is anchored around the frame 14, and the other end goes in the pelt 10.

As shown in FIGS. 1 and 5, each of the hooks 12 has a central portion and opposite end portions lying substantially in a common plane. The end portions of each hook 12 are convergent approaching their extremities, to achieve the desired hooking action.

The frame 14 is convenient to use, because a pelt can be placed in it and the frame can be adjusted to fit the pelt while the clamp 22 is enclamped. The clamp 22 is then tightened, and the hooks 12 can quickly be connected between the pelt and the frame 14 around its periphery. If it should turn out, part of the way through the operation, that some adjustment of the size of the frame 14 is needed, this can readily be accomplished by loosening the clamp 22, sliding the hooked ends of the overlapping wires 16 and 18 along each other, and then retightening the clamp 22 when the desired adjustment has been made.

While the frame of the invention could be used on various pelts, it is presently believed that its primary usefulness is for stretching beaver pelts.

While a present preferred embodiment and practice of the invention has been illustrated and described, it will be understood that the invention may be otherwise variously embodied and practiced within the scope of the following claims.

I claim:

1. A pelt stretching device which comprises a frame in the form of an elongated resilient element extending in a circle of variable circumference and having a pair of overlapping end portions, each of said end portions having an element integral therewith adjacent its extremity, said integral element extending around and holding the other said end portions, but each end portion being slidable lengthwise through the integral element which holds it, whereby the integral elements hold the frame in a circular shape but are slidable along the frame to vary the circumference of the frame, a releasable clamp mounted on the overlapping end portions between the integral elements and adapted to lock the two end portions together when the frame has been adjusted to a desired stretching circumference, and means to connect the frame to a pelt surrounded by the frame.

2. A device in accordance with claim 1, in which the connecting means comprises U-shaped hooks, each hook comprising a central part and a pair of opposite end parts all lying substantially in a common plane, each pair of end parts extending in the same direction from the central part but being convergent approaching their extremities, and each end part being capable of hooking through a marginal portion of a pelt surrounded by the frame while the other end part extending from the same central part hooks over the outside of the frame.

3. A pelt stretching device which comprises a frame in the form of an enlongated resilient element extending in a circle of variable circumference and having a pair of overlapping end portions, each of said end portions having an element integral therewith adjacent its extremity, said integral element extending around and holding the other of said end portions, but each end portion being slidable lengthwise through the integral element which holds it, whereby the entegral elements hold the frame in a circular shape but are slidable along the frame to vary the circumference of the frame, and a releasable clamp mounted on the overlapping end portions between the entegral elements and adapted to lock the two end portions together when the frame has been adjusted to a desired stretching circumference, said frame being of a size and form suitable for stretching a beaver pelt surrounded by the frame.

* * * * *